United States Patent [19]

Aaron

[11] 4,169,413

[45] Oct. 2, 1979

[54] BELT PRESS WITH SEPARABLE WEB-HANDLING AND BELT-SUPPORTING ASSEMBLIES

[75] Inventor: Charles Aaron, West Caldwell, N.J.

[73] Assignee: Midland-Ross Corporation, Cleveland, Ohio

[21] Appl. No.: 879,342

[22] Filed: Feb. 21, 1978

[51] Int. Cl.[2] ..... B41F 5/06; B41F 5/10; B41F 5/16

[52] U.S. Cl. ..... 101/223; 101/181; 101/224

[58] Field of Search ..... 101/219, 229, 220, 221, 101/222, 223, 224–228, 181, 182, 179, 180, 247

[56] References Cited

U.S. PATENT DOCUMENTS

| | | | |
|---|---|---|---|
| 881,167 | 3/1908 | Thomas | 101/181 X |
| 2,122,128 | 6/1938 | Burroughs | 101/181 |
| 2,896,536 | 7/1959 | Sauerman | 101/216 X |
| 3,094,066 | 6/1963 | Kendrick | 101/216 |
| 3,518,940 | 7/1970 | Stroud et al. | 101/223 |

FOREIGN PATENT DOCUMENTS

| | | | |
|---|---|---|---|
| 2234089 | 1/1974 | Fed. Rep. of Germany | 101/181 |
| 1003887 | 9/1965 | United Kingdom | 101/178 |

*Primary Examiner*—J. Reed Fisher
*Attorney, Agent, or Firm*—Harlan E. Hummer

[57] ABSTRACT

A belt-type printing machine, having a stationary web-handling assembly, including a pair of impression rolls, and a plurality of belt-supporting assemblies which are mobile and separable from the web-handling assembly, is disclosed. The belt-supporting assemblies each carry a plate support roll and an endless conveyor belt to which a number of printing plates are bonded. The belt-supporting assemblies are each stabilized in a printing position adjacent the web-handling assembly, by locking the plate roll adjacent an impression roll to form between the rolls, a nip through which the web and belt pass. The rolls are locked together in such a way that the rolls of the belt-supporting assembly and web-handling assembly are driven, in unison. A pair of mobile, belt-supporting assemblies are provided for each impression roll of the web-handling assembly, so that one of the belt-supporting assemblies can be removed to a remote location for rebelting while the other is in operation.

12 Claims, 4 Drawing Figures

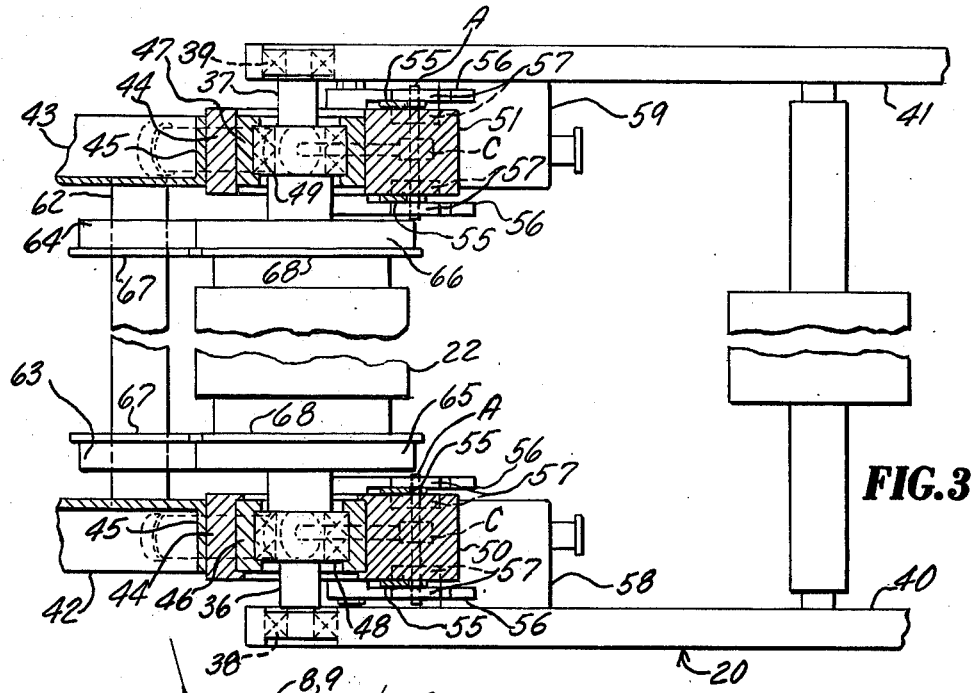
FIG.3
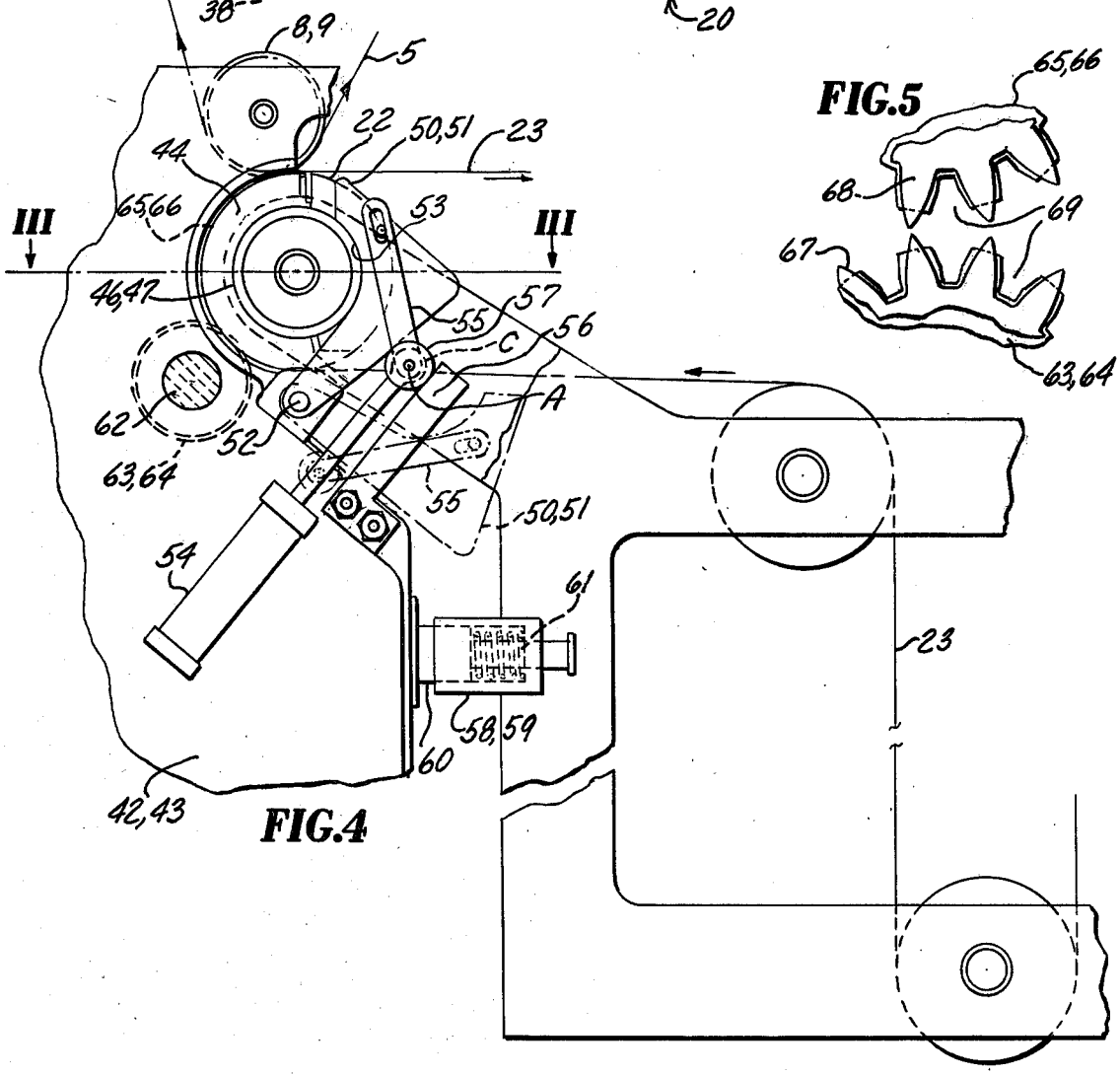
FIG.4
FIG.5

BELT PRESS WITH SEPARABLE WEB-HANDLING AND BELT-SUPPORTING ASSEMBLIES

BACKGROUND OF THE INVENTION

The invention is an improvement in the automatic belt-type printing machine described in U.S. Pat. No. 3,518,940 which is directed to a machine having a web-handling assembly and associated belt-supporting assemblies which are stationary and in fixed relation to each other. Upon completion of a particular printing job, the machine must be shutdown and idled to permit the operators to change the printing belts on the belt-supporting assemblies and make the machine ready for the next printing job. This is costly and time consuming. The invention is directed to solving this problem by reducing the downtime of the machine experienced during the changing of the printing belts of the belt-supporting assemblies.

SUMMARY OF THE INVENTION

Briefly stated, the invention is in a belt-type printing machine or press having a belt-supporting assembly which is mobile and separable from a web-handling assembly. Although either assembly may be mobile and the other stationary, the most practical form of the machine requires that the web-handling assembly be stationary and the belt-supporting assembly be mobile and separable from the web-handling assembly. Means are provided for guiding and locking the assemblies together, so that a plate supporting roll of the belt-supporting assembly is firmly positioned adjacent an impression roll of the web-handling assembly. Moreover, means are supplied for driving the plate roll, in unison, with the rolls of the web-handling assembly.

An important advantage of the invention is in the reduction of downtime experience during changing of the printing belts for different printing jobs. To accomplish this, a pair of belt-supporting assemblies are used in conjunction with each impression roll of the web-handling assembly, so that one belt-supporting assembly can be rebelted as the other belt-supporting assembly is in printing relation with a web being handled by the web-handling assembly. Each of the belt-supporting assemblies are mounted on separate carriages which are movable along trackways leading to an impression roll of the web-handling assembly. The trackways are so located and of such a length, that each one of a pair of belt-supporting assemblies can be removed out of interfering relation with the other of the pair of belt-supporting assemblies, as they are alternately moved into printing position adjacent an impression roll of the belt-handling assembly.

A belt-type printing press designed to print opposite sides of a web, comprises a pair of impression rolls which are located, in series, along the pathway which the web travels as it moves over and between the various rolls of the web-handling assembly. Accordingly, such a press requires the use of four separate belt-supporting assemblies for maximum efficiency.

BRIEF DESCRIPTION OF THE DRAWING

The following description of the invention will be better understood by having reference to the accompanying drawing, wherein:

FIG. 3 is a portion of a belt-supporting assembly in juxtaposition with a portion of the web-handling assembly, as viewed from the line III—III of FIG. 4;

FIG. 4 is a side view of portions of the assemblies of FIG. 3; and

FIG. 5 is a side view of portions of meshing gears carried by the web-handling assembly and plate roll of each belt-supporting assembly.

DETAILED DESCRIPTION OF THE DRAWING

Figure 1:
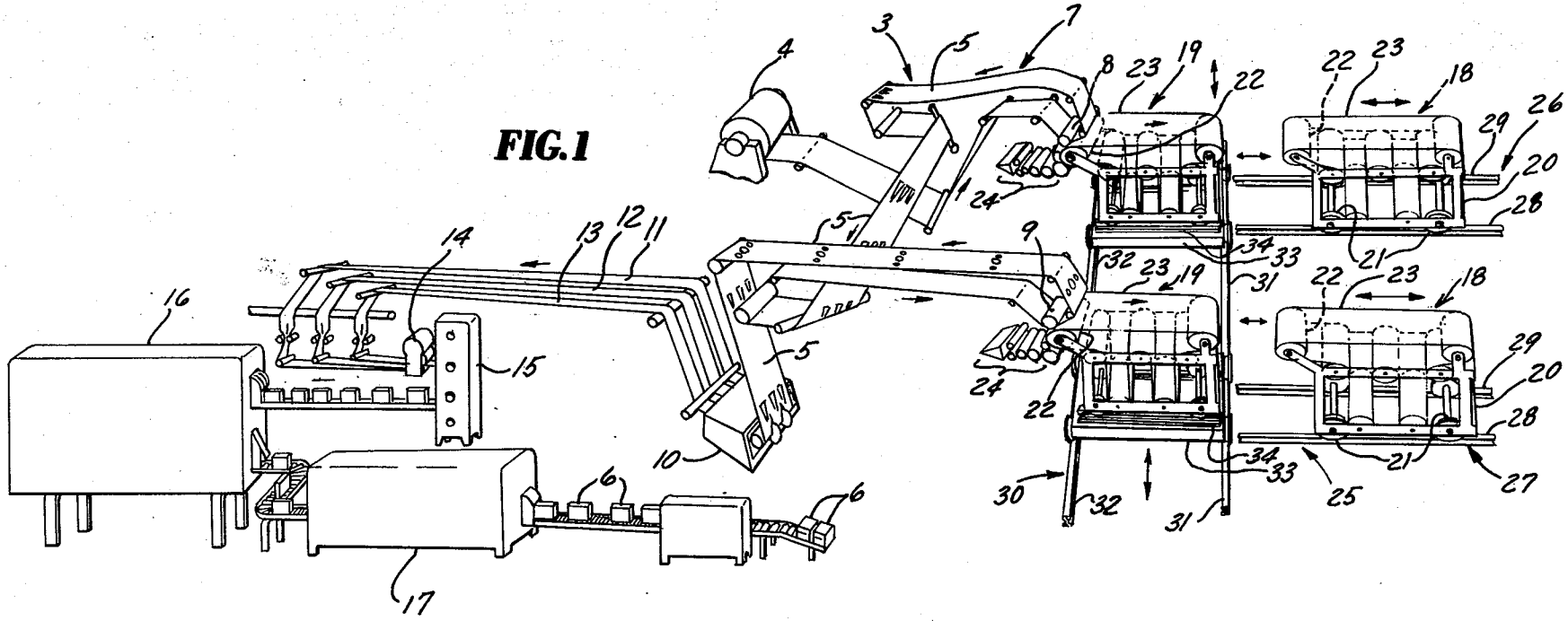
FIG. 1 is a perspective view of a belt-type printing press made in accordance with the invention.

With reference to FIG. 1, there is shown a belt-type printing machine or press 3 which has the capability of processing a roll 4 of blank paper 5, located at one end of the press 3, into bound paperback books 6 that are discharged at the other end of the press 3. The printing press 3 essentially comprises: a web handling assembly 7 which includes a pair of spaced impression rolls 8,9 that are rotatable about their coaxially aligned longitudinal axes, the paper 5 being printed on opposite sides at the impression rolls 8,9; a slitter 10 which is disposed downstream from the last-to-encounter impression roll 9, for cutting the paper 5 into narrow sheets or ribbons 11–13 which have a desired width corresponding to one or more pages of the book 6; a second cutting mechanism 14 for transversely cutting the paper ribbons 11–13 into individual sheets or pages; a collator 15 for sorting and stacking the pages of each book 6 into separate piles; an apparatus 16 for trimming and gluing the pages of each book together; and a book binding device 17 for binding the pages of each book and covering them with a hard or, in this case, a soft cover for discharge onto a conveyor as finished, bound paperback books 6.

A pair of belt-supporting assemblies 18,19 are provided for use in conjunction with each of the impression rolls 8,9 of the web-handling assembly 7. The belt-supporting assemblies 18,19 are mobile and separable from the web-handling assembly 7. The belt-supporting assemblies 18,19 are of generally the same design and comprise a fixed frame or carriage 20 which is mounted on a plurality of flanged, railroad car-type wheels 21. A plurality of guide rolls, including a forwardly disposed plate roll 22, are strategically located on the carriage 20 to form a pathway which corresponds, in length, to a continuous printing belt 23 which is reeved around and between the rolls that are mounted on the carriage 20 for rotation around parallel axes. A number of printing plates (not shown because of their small size) are conventionally bonded to the printing belt 23, the plates being used to print the desired material on the paper 5 as the printing belt 23 and paper 5 pass between the nips of the plate rolls 22 and impression rolls 8,9. The belt-supporting assemblies 18,19 are alternately moved into position adjacent the web-handling assembly 7 where the plate rolls 22 are adjacent and parallel the impression rolls 8,9.

An inking mechanism or train 24 is provided adjacent each of the impression rolls 8,9 of the web-handling assembly 7 for inking the printing plates on the printing belts 23, prior to their contact with the paper 5.

Any suitable trackway arrangement 25 can be provided for guiding the belt-supporting assemblies 18,19 into position adjacent the web-handling apparatus 7.

For example, as best seen in FIG. 1, there is shown a pair of parallel trackways 26,27 which extend axially toward the impression rolls 8,9. Each of the trackways 26,27 include a pair of parallel rails 28,29 along which the flanged wheels 21 of the carriages 20 roll. A third trackway 30, having parallel rails 31,32, is transversely disposed to the parallel trackways 26,27. The three trackways 26,27,30 are in the same horizontal plane and intersect. Conventional rail crossovers are provided at the intersections of the trackways so that the rearwardly and forwardly located belt-supporting assemblies 18,19 can be moved alternately along their respective trackways into the same printing positions adjacent the impression rolls 8,9 of the web-handling assembly 7. The rearwardly and forwardly located belt-supporting assemblies 18,19 can be identical in size and design providing the rotational axes of the flanged wheels 21 on the forwardly located belt-supporting assembly 19, are parallel to the longitudinal axis of the carriage 20 rather than being at right angles to said axis, as is the case of the rearwardly located belt-supporting assemblies 18 which are designed to move axially and not laterally or sideways.

As an alternate method of moving the forwardly located belt-supporting assemblies 19 sideways along the third trackway 30, an undercarriage 33 is interposed between each of the carriages 20 and the third trackway 30. The undercarriages 33 are likewise mounted on flanged wheels which are rollable along the rails 31,32 of the third trackway 30. The undercarriages 33 each support a short trackway 34 having parallel rails which are transversely disposed to the longitudinal axis of the third trackway 30 and parallel to the longitudinal axes of the other two trackways 26,27. It can be appreciated that, in such cases, the height of the carriage 20 must be reduced in accordance with the height of the undercarriages 33 and the rolls relocated on the carriage 20 so that the plate rolls 22 carried by the carriages 20, will be maintained in proper printing relation to the impression rolls 8,9, and the pathway of the printing belts 23 around the rolls of the carriages 20 will still correspond to the length of the belts 23.

Figure 2:
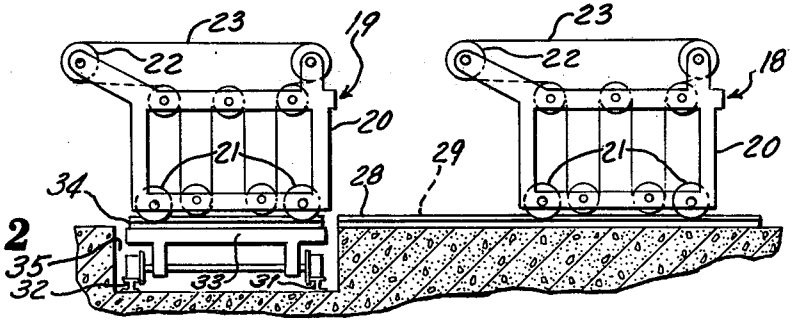
FIG. 2 is a side view of two identical belt-supporting assemblies and a trackway arrangement which is consequently different from that of FIG. 1 where two differently sized belt-supporting assemblies are used.

Another modification of the trackway arrangement 25 is seen in FIG. 2. This particular arrangement permits the utilization of undercarriages 33 on the third trackway 30 and identically sized forwardly and rearwardly located belt-supporting assemblies 18,19. The third trackway 30 is disposed in a recessed channel 35, so that the short trackways 34, supported on the undercarriages 33, are in the same horizontal plane as the other two parallel trackways 26,27. In such cases, still another one or two storage trackways are needed to permit removal of, for example, the forwardly located belt-supporting assemblies 19 from the undercarriages 33, so that the rearwardly located belt-supporting assemblies 18 can be moved thereon, if only two undercarriages 33 are used. The necessity for additional trackways can be eliminated, if four undercarriages 33 are utilized. Thus, it can be appreciated that there are a number of ways that can be employed to guide the belt-supporting assemblies 18,19 into proper printing relation with the impression rolls 8,9 of the web-handling assembly 7.

It is important to firmly secure the belt-supporting assemblies 18,19 adjacent the web-handling assembly 7. It is also desirable to utilize the drive mechanism of the web-handling assembly 7 to drive at least the plate rolls 22 of the belt-supporting assemblies 18,19 in synchronized relation with the impression rolls 8,9 of the web-handling assembly 7. Any suitable mechanisms may be utilized to accomplish this.

For example, as best seen in FIGS. 3 and 4, the plate rolls 22 are each provided with opposing shaft extensions 36,37 which are journalled for rotation in bearings 38,39 that are supported in the upstanding sideframes 40,41 of the carriage 20. A pair of outstanding arms or frame members 42,43 extend in parallel relation from the web-handling assembly 7 adjacent each of the impression rolls 8,9. The outstanding arms 42,43 are more closely spaced than the adjacent sideframes 40,41 of the carriage 20 of each of the belt-supporting assemblies 18,19. A clamp halve in the form of a stationary clamp jaw 44 having a semi-circular, concavely shaped recess is disposed adjacent the free end 45 of each of the outstanding arms 42,43 for receiving circular housings 46,47 which have enclosed bearings 48,49 and are mounted on the shaft extensions 36,37 of each of the plate rolls 22.

A second pair of clamp halves in the form of a pair of movable clamp jaws 50,51, are rotatably mounted on the pair of outstanding arms 42,43 by any suitable means, e.g. pivot pins 52. The movable clamp jaws 50,51 are designed to engage the circular housings 46,47 of a tentatively positioned plate roll 22 and pull them into the adjacent semi-circular recesses of the fixed clamp jaws 44 where they are firmly held to properly position the plate rolls 22 adjacent and parallel the impression rolls 8,9. The movable clamp jaws 50,51 each have a concavely curved inner periphery 53 which is complementary to the outer curved surface of the housings 46,47. The movable clamp jaws 50,51 are rotatable in planes which are normal to the longitudinal axes of the impression rolls 8,9, and the plate rolls 22 when the plate rolls 22 are positioned adjacent the impression rolls 8,9. An air or hydraulic cylinder 54, secured to each of the outstanding arms 42,43, is coupled to each of the movable clamp jaws 50,51 by a link 55 which is designed to control the downward travel of the movable clamp jaws 50,51 out of engagement with the circular housing 46,47 on the shaft extensions 36,37. A pair of dog-leg shaped slide bars 56 are secured to each of the outstanding arms 42,43 to support one of a pair of closely spaced rollers 57 which are rotatably mounted on opposing ends of an axle A that is carried by a clevis C which is disposed on the free distal end of the piston rod of each of the air cylinders 54. The air cylinders 54 are operated to move one of each of the pairs of closely spaced rollers 57 upwardly along the slide bars 56, whereby the other of each of the closely spaced rollers 57 is moved into wedging engagement with the movable clamp jaws 50,51 to rotate the jaws and force them into clamping engagement with the circular housings 46,47. The links 55 extending from the movable clamp jaws 50,51 are coupled to the axles between the closely spaced rollers 57, as best seen in FIG. 3.

A pair of spring-loaded snubbers or bumpers 58,59, fastened to the sideframes 40,41 of each carriage 20, are provided to resiliently engage the outstanding arms 42,43 of the web-handling assembly 7. Each of the snubbers 58,59 comprises a plunger 60 which is biased outwardly in a direction away from the carriage 20 by a coil spring 61.

A shaft 62 is rotatably mounted between the outstanding arms 42,43 adjacent each of the impression rolls 8,9. The shaft 62 is rotated by the drive mechanisms used to drive the various rolls of the web-handling assembly 5. A pair of drive gears 63,64 are keyed to each shaft 62 in spaced relation for meshing engagement with a pair of mating driven gears 65,66 that are keyed to the shaft extensions 36,37 of the plate rolls 22. Each pair of drive gears 63,64 and mating driven gears 65,66, as best seen in FIG. 5, comprise a set of auxiliary gears 67,68 to facilitate meshing of the drive gears 63,64 with the driven gears 65,66. The individual teeth of the auxiliary gears 67,68 are thinner than those of the drive and driven gears 63–66. Further, they extend beyond the teeth of the drive and driven gears 63–66 and are pointed, having sharp vertexes to enable the teeth of the auxiliary gears 67,68 to initiate meshing without jamming before the ends of the teeth of the drive and driven gears 63–66 having had an opportunity to engage. The valleys 69 between the teeth of the auxiliary gears 67,68 are correspondingly deeper than the valleys between the teeth of the drive gears 63,64 and the driven gears 65,66. Thus, the drive gears 63,64 and driven gears 65,66, carried by the drive shafts 62 and plate rolls 22, are brought into meshing engagement as the movable clamp jaws 50,51 are operated to move the plate rolls 22 firmly in position where the housings 46,47 rest in the semi-circular recesses 44 of the fixed clamp jaws adjacent the ends 45 of the outstanding arms 42,43.

One of the clamps, e.g. clamp 44,50 as best seen in FIG. 3, is provided with an annular recess for receiving the adjacent housing 46 and holding it in a fixed axial position, whereas the other of the clamps, e.g. clamp 44,51, has a smooth inner periphery to accommodate a variation in length of the plate rolls 22 due, for example, to expansion and contraction.

The impression rolls 8,9 and inking mechanisms 24 are conventionally mounted on the web-handling assembly 7 for limited movement to and from an adjacent plate roll 22, so that they can be properly positioned adjacent the plate rolls 22, after the plate rolls 22 have been clamped firmly in position. In this way, the impression rolls 8,9 and inking mechanism 24 are kept from interfering with the positioning of the plate rolls 22.

Thus, there has been provided a unique printing press having a stationary web-handling assembly and a belt-supporting assembly which is mobile and separable from the web-handling assembly, so that the belt-supporting assembly can be moved to a remote location where the printing belt can be readily removed and replaced with a new belt for printing different material. The downtime of the press, normally experienced during the rebelting operation, is substantially reduced by using a pair of belt-supporting assemblies in conjunction with each impression roll of the web-handling assembly, so that one belt-supporting assembly will always be in operation as the other one is being rebelted.

What is claimed is:

1. A belt-type printing press comprising:

(a) a stationary web-handling assembly comprising at least one impression roll which is rotatable about its longitudinal axis and over which a web advances as the roll rotates;

(b) a mobile belt-supporting assembly which is separable from the web-handling assembly and which comprises a plate roll and other strategically located rolls for supporting a continuous printing belt with attached printing plates, the plate roll being rotatable about its longitudinal axis;

(c) means for guiding the belt-supporting assembly to a position adjacent the web-handling assembly, where the plate roll is close to, and parallel with, the impression roll and forms with the impression roll a nip through which the web and printing belt pass;

(d) means carried by the web-handling assembly for engaging and holding the belt-supporting assembly about the plate roll axis to secure the plate roll in nip forming relation with the impression roll and for holding the plate roll in a position where the rotational axis of the plate roll is in fixed, parallel relation to the rotation axis of the impression roll; and (e) means for rotating the rolls of the assemblies in synchronized relation.

2. The belt-type printing press of claim 1, wherein the roll rotating means (e) includes:

(g) mating gears carried by the plate roll and web-handling assembly; and (h) means positioned gears on the web-handling assembly for meshing engagement with mating gears carried by the plate roll, when the plate roll is in said position adjacent the impression roll.

3. The belt-type printing press of claim 1, wherein the guiding means (c) for the belt supporting assembly includes:

(g) a first trackway extending toward the impression roll and having its longitudinal axis angularly disposed to a plane containing the rotational axis of the impression roll; and (h) means mounting the belt-supporting assembly for movement along the trackway.

4. The belt-type printing press of claim 3, which includes:

(i) a second trackway having its longitudinal axis normal to the longitudinal axis of the first trackway;

(j) a second belt-supporting assembly, having a similar plate roll;

(k) means mounting the second belt-supporting assembly for movement along the second trackway to said position adjacent the web-handling assembly when the other belt-supporting assembly is removed from said position.

5. The belt-type printing press of claim 4, which includes:

(l) means mounting the impression roll for limited movement to and from a fixed rotational position adjacent the plate roll, when the plate roll is in said position; and (m) means for inking printing plates, carried by the belt-supporting assembly, prior to contact with the web.

6. The belt-type printing press of claim 5, wherein the means (h),(k) for mounting the belt-supporting assemblies for movement along the trackways, each includes:

(n) a carriage mounted on wheels which are movable along the trackways;

(o) means mounting a plurality of rolls, including a plate roll, on the carriage for rotation about axes which are parallel and normal to the longitudinal axis of the carriage, the rolls forming a pathway for the endless printing belt corresponding to the length of the belt.

7. The belt-type printing press of claim 6, wherein the second belt-supporting assembly which moves along the second trackway includes:

(p) an undercarriage mounted on wheels which are movable along the second trackway;

(q) a third trackway mounted on the undercarriage at right angles to the second trackway, for supporting the wheels and carriage of the second belt-supporting assembly.

8. A belt-type printing press, comprising in combination:

(a) a stationary web-handling assembly, including a pair of spaced impression rolls, each of which is rotatable about its longitudinal axis;

(b) a first trackway leading to the first of said pair of impression rolls from a point remote therefrom, the longitudinal axis of said trackway being normal to the longitudinal axis of said first impression roll;

(c) a second trackway leading to the second of said pair of impression rolls from a point remote therefrom, the longitudinal axis of said second trackway being normal to the longitudinal axis of said second impression roll;

(d) a pair of belt-supporting assemblies moveable independently along the trackways to and from positions adjacent the web-handling assembly, each of the belt-supporting assemblies having a plurality of rolls, including a plate roll which is rotatable about its longitudinal axis, defining a pathway for an endless printing belt that is reeved around and between the rolls, the plate rolls being adjacent and parallel to the impression rolls when the belt-supporting assemblies are in said positions adjacent the web-handling assembly;

(e) means coacting with the web-handling assembly for holding the plate rolls securely adjacent and parallel the impression rolls, to form therebetween, nips through which the web and belt pass as the web is printed;

(f) gears coupled to each of the plate rolls and web-handling assembly for meshing engagement when the plate rolls are secured in said positions adjacent the impression rolls;

(g) means for driving the gears to correspondingly rotate the impression rolls and plate rolls in synchronized relation;

(h) at least a third trackway disposed normal to said first and second trackways which are parallel; and (i) a second pair of belt-supporting assemblies movable independently along the third trackway to and from the positions which the other pair of belt-supporting assemblies occupy when adjacent the web-handling assembly, each of the second pair of belt-supporting assemblies likewise having a plate roll which is rotatable about its longitudinal axis, the plate rolls of the second pair of belt-supporting assemblies likewise being positionable adjacent and parallel the impression rolls.

9. The belt-type printing press of claim 8, wherein the holding means (e) for the plate rolls includes:

(I) a pair of outstanding arms extending from the web-handling assembly adjacent each of the impression rolls;

(II) a pair of clamp halves adjacent the outstanding end of each arm for engaging and holding a belt-supporting assembly adjacent opposing ends of the plate rolls, each of said pairs of clamp halves including a fixed clamp jaw and a movable clamp jaw;

(III) means mounting the movable clamp jaws on the outstanding arms for rotation in parallel planes which are normal to the longitudinal axis of the impression rolls; and (IV) means coacting between the arms and movable clamp jaws for rotating said jaws into compressive engagement with a tentatively positioned belt-supporting assembly adjacent opposing ends of the plate roll to move said adjacent opposing ends of the plate roll against the fixed clamp jaws where they are held between said clamp halves and said plate roll is in position adjacent an impression roll.

10. The belt-type printing press of claim 9, which includes:

(j) means for inking printing plates carried by the belt-supporting assemblies, prior to the plates printing engagement with the web as the web and printing plates pass through the nips between the plate and impression rolls;

(k) means for inverting the web between the impression rolls, so that the face of the web printed upon at the first-to-contact impression roll is not again printed upon at the second-to-contact impression roll;

(l) means, downstream of the second-to-contact impression roll, for slitting the web longitudinally into a plurality of narrow ribbons;

(m) means, downstream of the web slitting means for transversely cutting the ribbons into individual pieces;

(n) means, downstream of the ribbon cutting means, for collating the pieces into stacks; and (o) means, downstream of the collating means, for successively trimming and gluing pieces of each stack and then binding and covering the pieces of each stack.

11. The belt-type printing press of claim 10, wherein the gears coupled to the plate rolls and web-handling assembly include a pair of mesh-expediting gears attached to each pair of meshing gears, each of the mesh-expediting gears having the same number of similarly arcuately spaced teeth as an associated meshing gear as to be in juxtaposed alignment with the teeth of an associated meshing gear, the teeth of the mesh-expediting gears being radially longer, narrower and more pointed than the teeth of the pair of meshing gears, so that the corresponding valleys between adjacent teeth of the mesh-expediting gears are deeper and wider than the valleys between adjacent teeth of the pair of meshing gears.

12. A belt-type printing press comprising:

(a) a stationary web-handling assembly comprising at least one impression roll which is rotatable about its longitudinal axis and over which a web advances as the roll rotates;

(b) a mobile belt-supporting assembly which is separable from the web-handling assembly and which comprises a plate roll and other strategically located rolls for supporting a continuous printing belt, the plate roll being rotatable about its longitudinal axis;

(c) means for guiding the belt-supporting assembly to a position adjacent the web-handling assembly, where the plate roll is close to, and parallel with, the impression roll and forms with the impression roll a nip through which the web and printing belt pass;

(d) means for securing the belt-supporting assembly in the position adjacent the web-handling assembly, including means coacting with the web-handling assembly for holding the plate roll in a position where the rotational axis of the plate roll is in fixed, parallel relation to the rotational axis of the impression roll, the plate roll holding means, comprising:

(I) a pair of clamp halves, including a stationary and movable clamp jaws, configured to engage and hold the belt-supporting assembly adjacent opposing ends of the plate roll, when the plate roll is positioned adjacent the impression roll;

(II) means mounting the movable clamp jaws on the web-handling assembly for rotation in parallel planes which are normal to the longitudinal axis of an adjacent plate roll; and (III) means coacting with the web-handling assembly for rotating the movable clamp jaws to and from the fixed clamp jaws; and (e) means for rotating the rolls of the assemblies in synchronized relation.

* * * * *